US006568546B1

(12) United States Patent
Huang

(10) Patent No.: US 6,568,546 B1
(45) Date of Patent: May 27, 2003

(54) ROTARY HANGER DEVICE

(76) Inventor: Steve Huang, 3F, No. 50, Lane 1, Da Han St., Shen Gang Hsiang, Taichung Hsien (TW)

( * ) Notice: Subject to any disclaimer, the term of this patent is extended or adjusted under 35 U.S.C. 154(b) by 0 days.

(21) Appl. No.: 10/057,715

(22) Filed: Jan. 25, 2002

(51) Int. Cl.[7] ..... A47B 47/00
(52) U.S. Cl. ..... 211/205
(58) Field of Search ..... 211/205, 96, 168, 211/196, 85.3, 16, 45, 133.4, 163, 199, 204

(56) References Cited

U.S. PATENT DOCUMENTS

| | | | | | |
|---|---|---|---|---|---|
| 284,090 | A | * | 8/1883 | Tingle | 211/103 |
| 342,476 | A | * | 5/1886 | Swartwout | 211/103 |
| 496,173 | A | * | 4/1893 | Smith | 206/9 |
| 1,162,298 | A | * | 11/1915 | Metcalf | 211/106 |
| 1,947,325 | A | * | 2/1934 | Bailey | 211/88.01 |
| 2,595,521 | A | * | 5/1952 | Hanson | 16/223 |
| 2,633,997 | A | * | 4/1953 | Johnson | 211/96 |
| 2,692,689 | A | * | 10/1954 | Wynne, Sr. | 108/139 |
| 3,197,034 | A | * | 7/1965 | Deadrick | 211/1 |
| 3,648,892 | A | * | 3/1972 | Morgan | 108/95 |
| 4,889,246 | A | * | 12/1989 | Lee | 211/163 |
| 5,318,189 | A | * | 6/1994 | Lee | 211/196 |
| 5,535,896 | A | * | 7/1996 | Morgan, Sr. | 211/168 |
| 5,746,334 | A | * | 5/1998 | Brandenberg | 211/205 |
| 6,158,360 | A | * | 12/2000 | Cheng | 108/103 |
| 6,196,398 | B1 | * | 3/2001 | Lowe | 211/87.01 |
| 6,206,210 | B1 | * | 3/2001 | Reed | 211/168 |
| 6,425,490 | B1 | * | 7/2002 | Ta | 211/116 |

* cited by examiner

*Primary Examiner*—Alvin Chin-Shue
*Assistant Examiner*—Sarah Purol
(74) *Attorney, Agent, or Firm*—Alan D. Kamrath; Rider Bennett, LLP

(57) ABSTRACT

A hanger device includes a support rod, a plurality of support members mounted around the support rod in a stacked manner, and a plurality of the hanger rods each having a ring rotatably mounted around an associated support member. Each support member includes a stepped portion around which the ring of an associated hanger rod is rotatably mounted.

13 Claims, 11 Drawing Sheets

ROTARY HANGER DEVICE

BACKGROUND OF THE INVENTION

1. Field of the Invention

The present invention relates to a rotary hanger device, and more particularly to a hanger device having a plurality of hanger rods rotatably mounted to a support rod thereof.

2. Description of the Related Art

FIGS. 10 and 11 of the drawings illustrate a conventional hanger device for hanging clothes. The hanger device includes a base 1' with an upright post 2'. A lower positioning member 40' is mounted to an upper end of the upright post 2' and a lower end of a screw rod 30' is extended into the lower positioning member 40' and retained in place by a nut 60'. An outer tube 70' is mounted around the screw rod 30' with an upper end of the screw rod 30' extended beyond the outer tube 70'. A plurality of hanger members 20' are mounted around the outer tube 70' in a stacked manner, and an upper positioning member 10' is engaged with the upper end 12' of the screw rod 30' and retained in place by a nut 50', thereby preventing disengagement of the hanger members 20', best shown in FIG. 11. Each hanger member 20' includes a sleeve 24' that is rotatably mounted around the outer tube 70' and a rod 26' extended radially outward from an outer periphery of the sleeve 24', the rod 26' having an enlarged distal end 22'.

Nevertheless, assembly of the hanger device is troublesome. Rotation of the hanger member 20' may cause a break in a junction area between the sleeve 24' and the rod 26'. In addition, rotation of the hanger members 20' located around the lower portion of the outer tube 70' is not easy, as there are many hanger members 20' that are stacked upon and thus exert a load to them due to the existence of increased friction.

SUMMARY OF THE INVENTION

It is the primary object of the present invention to provide an improved hanger device having a plurality of hanger rods rotatably mounted to a support rod thereof. The hanger rods can be assembled/disassembled easily and quickly. In addition, the number of the hanger members can be chosen according to need.

In accordance with a first aspect of the invention, a hanger device comprises:

a support rod;

a plurality of support members mounted around the support rod in a stacked manner; and a plurality of the hanger rods each having a ring rotatably mounted around an associated said support member.

In accordance with a second aspect of the invention, a hanger device comprises:

a base having a main post extending therefrom;

a support rod securely engaged with the main post;

a lower positioning block mounted around the support rod, the lower positioning block including a first stepped portion formed on an upper end thereof and a second stepped portion formed on an upper end of the first stepped portion;

an upper positioning block mounted around the support rod and located above the lower positioning block, the upper positioning block including a longitudinal through-hole having a countersink in a lower end thereof;

a plurality of support members mounted around the support rod and sandwiched between the lower positioning block and the upper positioning block in a stacked manner, each said support member including a first stepped portion formed on an upper end thereof and a second stepped portion formed on an upper end of the first stepped portion of the respective support member; and a plurality of the hanger rods each having a ring rotatably mounted around the first stepped portion of an associated said support member;

wherein the first stepped portion of the lower positioning block is fittingly received in the countersink of a lowermost one of the stacked support members, the first stepped portion of a lower one of each two adjacent said support members is fittingly received in the countersink of an upper one of each two adjacent said support members, and the first stepped portion of an uppermost one of the stacked support members is fittingly received in the countersink of the upper positioning block.

In accordance with a third aspect of the invention, a hanger device comprises:

a support rod having a lower end and an upper end;

a lower positioning block securely mounted around the lower end of the support rod, the lower positioning block including a first stepped portion formed on an upper end thereof and a second stepped portion formed on an upper end of the first stepped portion;

an upper positioning block securely mounted around the upper end of the support rod and located above the lower positioning block, the upper positioning block including a longitudinal through-hole having a countersink in a lower end thereof;

a plurality of support members mounted around the support rod and sandwiched between the lower positioning block and the upper positioning block in a stacked manner, each said support member including a first stepped portion formed on an upper end thereof and a second stepped portion formed on an upper end of the first stepped portion of the respective support member; and a plurality of the hanger rods each including a U-shaped rod having two limbs, a ring being formed on a distal end of each of the limbs, each said ring being rotatably mounted around the first stepped portion of an associated one of said support members;

wherein the first stepped portion of the lower positioning block is fittingly received in the countersink of a lowermost one of the stacked support members, the first stepped portion of a lower one of each two adjacent said support members is fittingly received in the countersink of an upper one of each two adjacent said support members, and the first stepped portion of an uppermost one of the stacked support members is fittingly received in the countersink of the upper positioning block.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
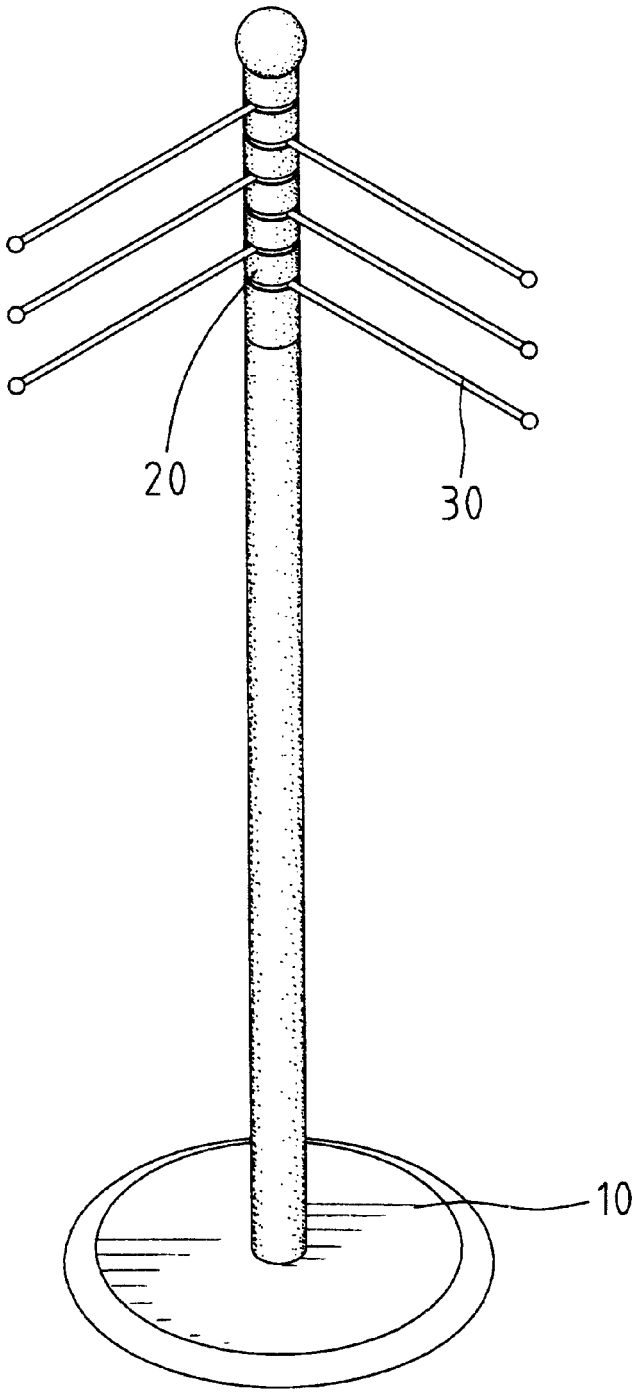
FIG. 1 is a perspective view of a rotary hanger device in accordance with the present invention.
Figure 2:
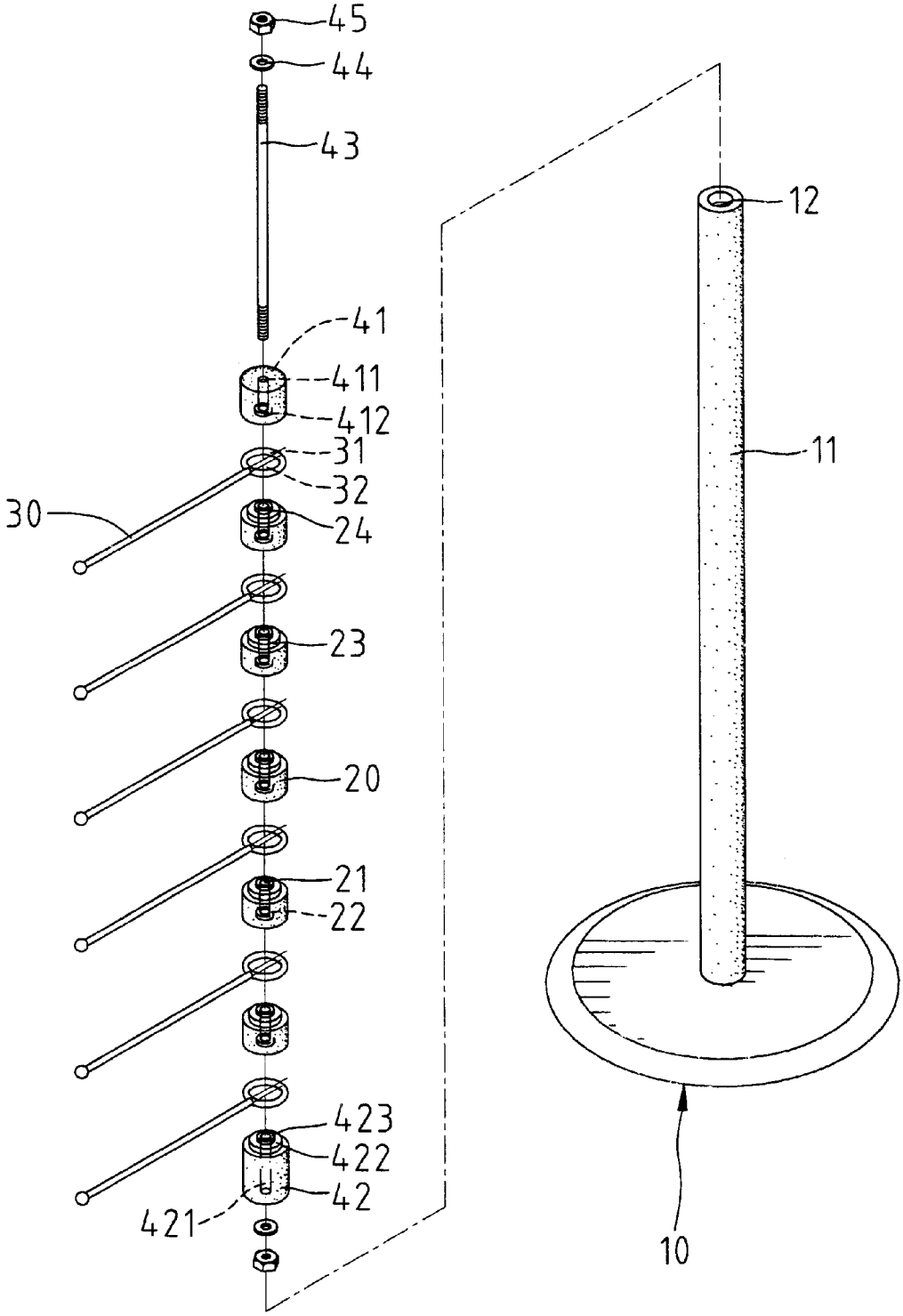
FIG. 2 is an exploded perspective view of the rotary hanger device in accordance with the present invention.
Figure 3:
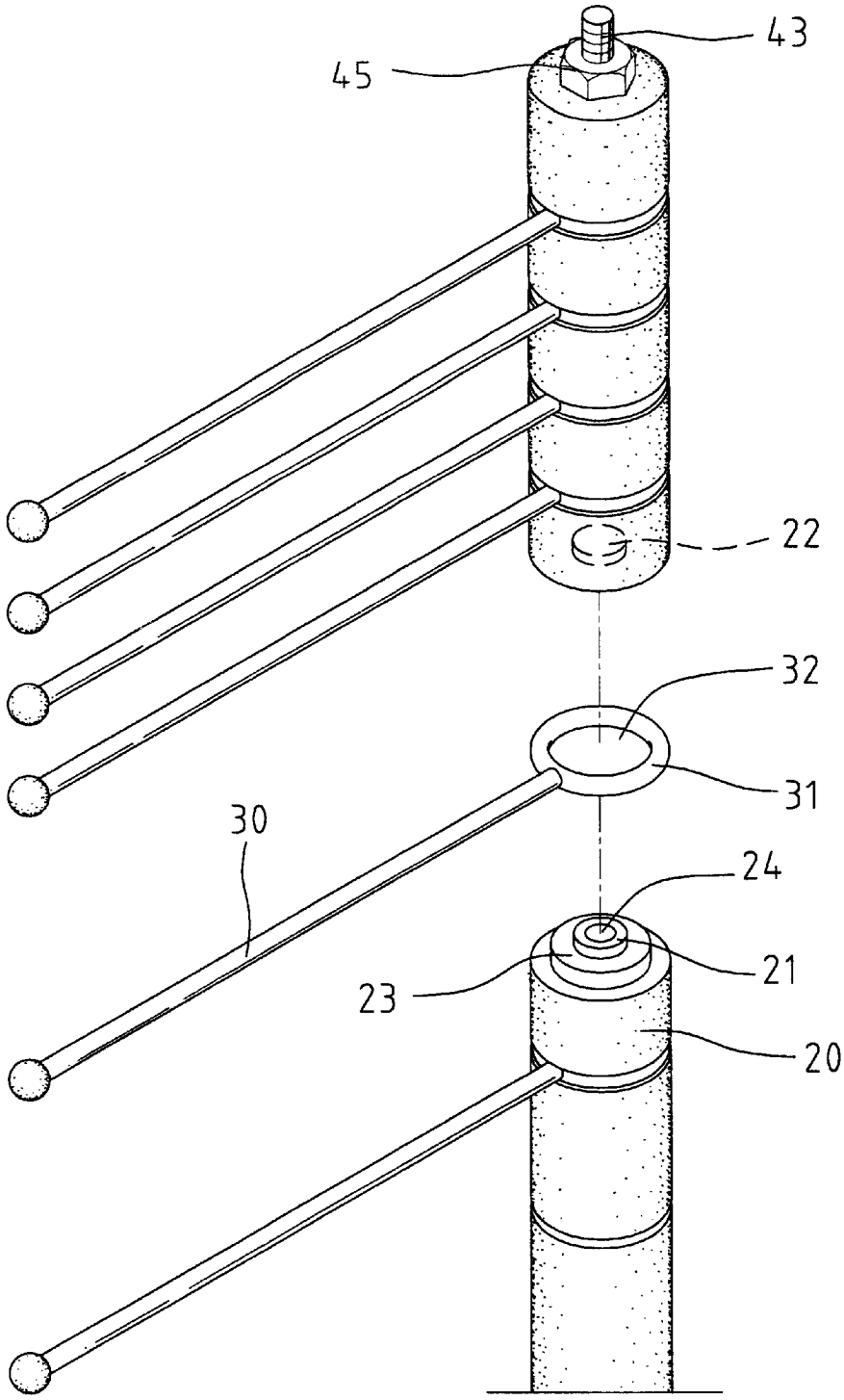
FIG. 3 is a partial perspective view of an upper portion of the rotary hanger device in accordance with the present invention.

Referring to FIGS. 1 through 4, a rotary hanger device in accordance with the present invention generally includes a base 10 with an upright main post 11 having a screw hole 12 in an upper end thereof, a plurality of support members 20, a plurality of rotary hanger rods 30, and a support rod 43. Each support member 20 includes a first stepped portion 23 formed on an upper end thereof and a second stepped portion 24 formed on an upper end of the first stepped portion 23. Each support member 20 further includes a longitudinal through-hole 21 that extends through an overall length thereof (including the first and second stepped portions 23 and 24) and that has a countersink 22 in a lower end thereof. Each rotary hanger rod 30 includes a rod with a ring 31 formed on an end thereof, the ring 31 having a hole 32 so as to be mounted around the first stepped portion 23 of an associated support member 20.

The hanger device further includes two nuts 45 and 46 and upper and lower positioning blocks 41 and 42 for assembly. The support rod 43 has a lower threaded end threadedly engaged with the screw hole 12 of the main post 11. The lower positioning block 42 has a through-hole 421 and first and second stepped portions 422 and 423, which are substantially the same as those of a respective support member 20 except for the countersink 22. The upper positioning block 41 includes a through-hole 411 having a countersink 412 in a lower end thereof.

Figure 4:
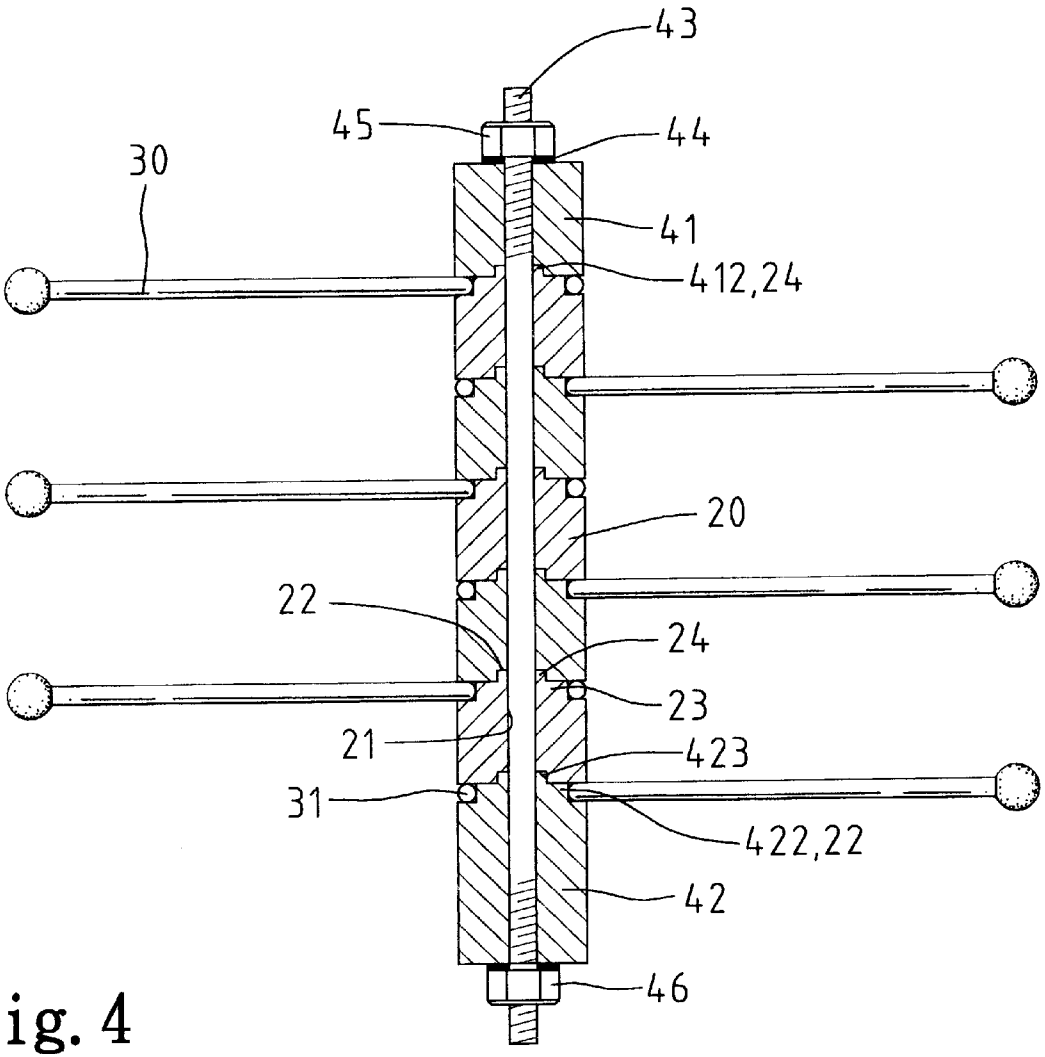
FIG. 4 is a sectional view of the upper portion of the rotary hanger device in accordance with the present invention.

In assembly, as illustrated in FIG. 4, the nut 46 is mounted to the lower threaded end of the support rod 43 at a position above the main post 11. Next, the lower positioning block 42 is mounted around the lower threaded end of the support rod 43 and rests on the nut 46. Then, the ring 31 of a respective hanger rod 30 is mounted around the first stepped portion 422 of the lower positioning block 42. Next, a support member 20 is mounted around the support rod 43 and stacked above the lower positioning block 42 with the second stepped portion 423 fittingly received in the countersink 22 of the support member 20. The ring 31 of another hanger rod 30 is mounted around the first stepped portion 23 of the support member 20 and another support member 20 is mounted around the support rod 43 and stacked above the previous support member 20 with the second stepped portion 24 of the lower support member 20 fittingly received in the countersink 22 of the upper support member 20. Thus, the support members 20 can be stacked one by one and the hanger rods 30 can be mounted between each two adjacent support members 20 and rotatably mounted around the first stepped portion 23 of the lower one of the two adjacent support members 20. When the support members 20 and the hanger rods 30 have been mounted by a required amount, the upper positioning block 41 is mounted around the support rod 43 and stacked above the uppermost support member 20 with the second stepped portion 24 of the uppermost member 20 fittingly received in the countersink 412 of the upper positioning block 41. Finally, a washer 44 is placed on and the nut 45 is threadedly engaged with an upper threaded end of the support rod 43 to thereby position all of the elements.

By such an arrangement, it is appreciated that assembly/disassembly of the hanger device in accordance with the present invention can be easily and quickly accomplished, and the total number of the support members 20 and the hanger rods 30 can be chosen according to need. In addition, each hanger rod 30 is rotatably mounted around an associated stepped portion 422, 23 such that rotation of each hanger rod 30 will not be adversely affected even for the lowermost hanger rod 30. The countersink 412, 22 and associated stepped portion 24, 423 provides reliable engagement for the overall hanger device. The hanger device can be made from wood. In a modified embodiment of the invention, the upper and lower positioning blocks 41 and 42 as well as the nuts 45 can be omitted.

Figure 5:
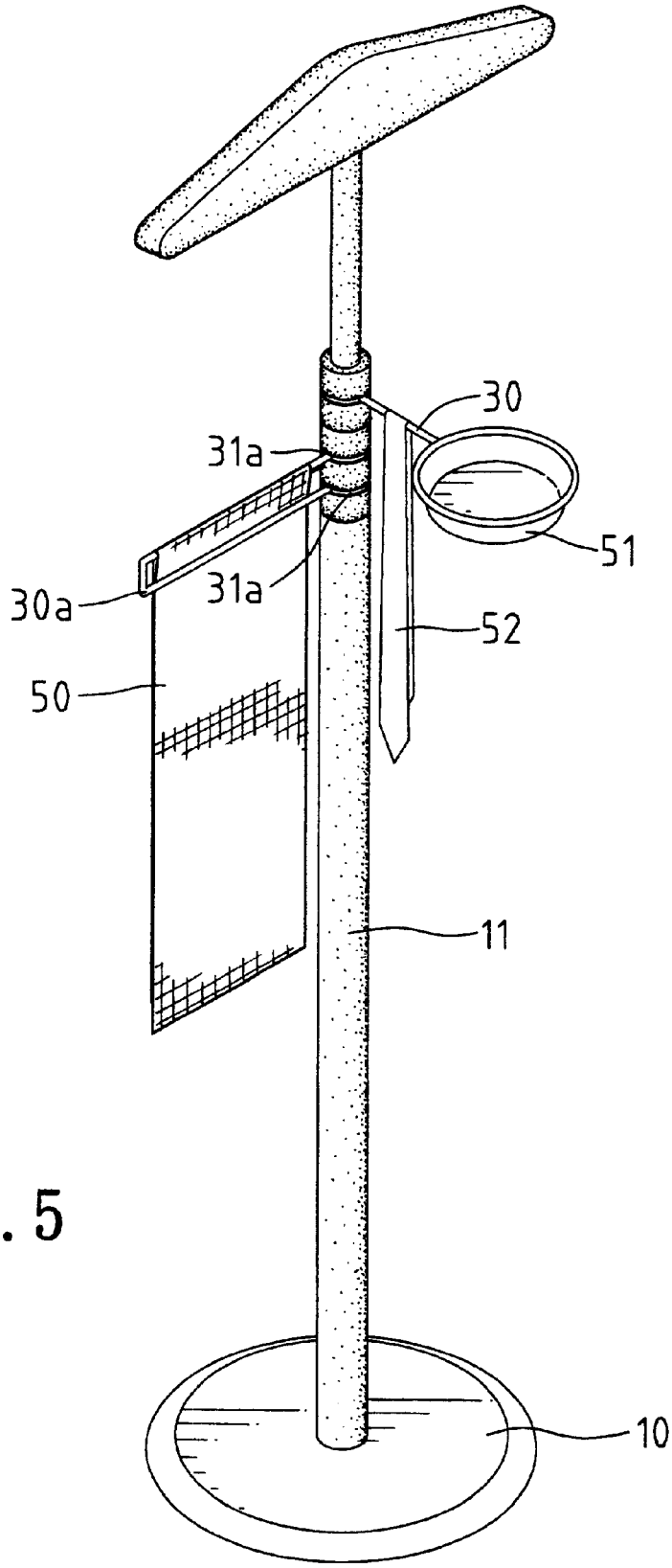
FIG. 5 is a perspective view of a modified embodiment of the rotary hanger device in accordance with the present invention.

FIG. 5 is a perspective view of a modified embodiment of the rotary hanger device in accordance with the present invention, wherein one of the rotary hanger rod 30*a* is substantially U-shaped and includes a ring 31*a* formed on a distal end of each of two limbs thereof. Each ring 31*a* of the rotary hanger rod 30*a* is mounted around the first stepped portion 23 of an associated support member 20. In particular, the rotary hanger rod 30*a* cooperates with two support members 20. A towel 50 can be hung on the rotary hanger rod 30*a*. In addition, an ashtray 51 may be formed on or provided to a distal end of another rotary hanger rod 30 on which a necktie 52 is hung.

Figure 6:
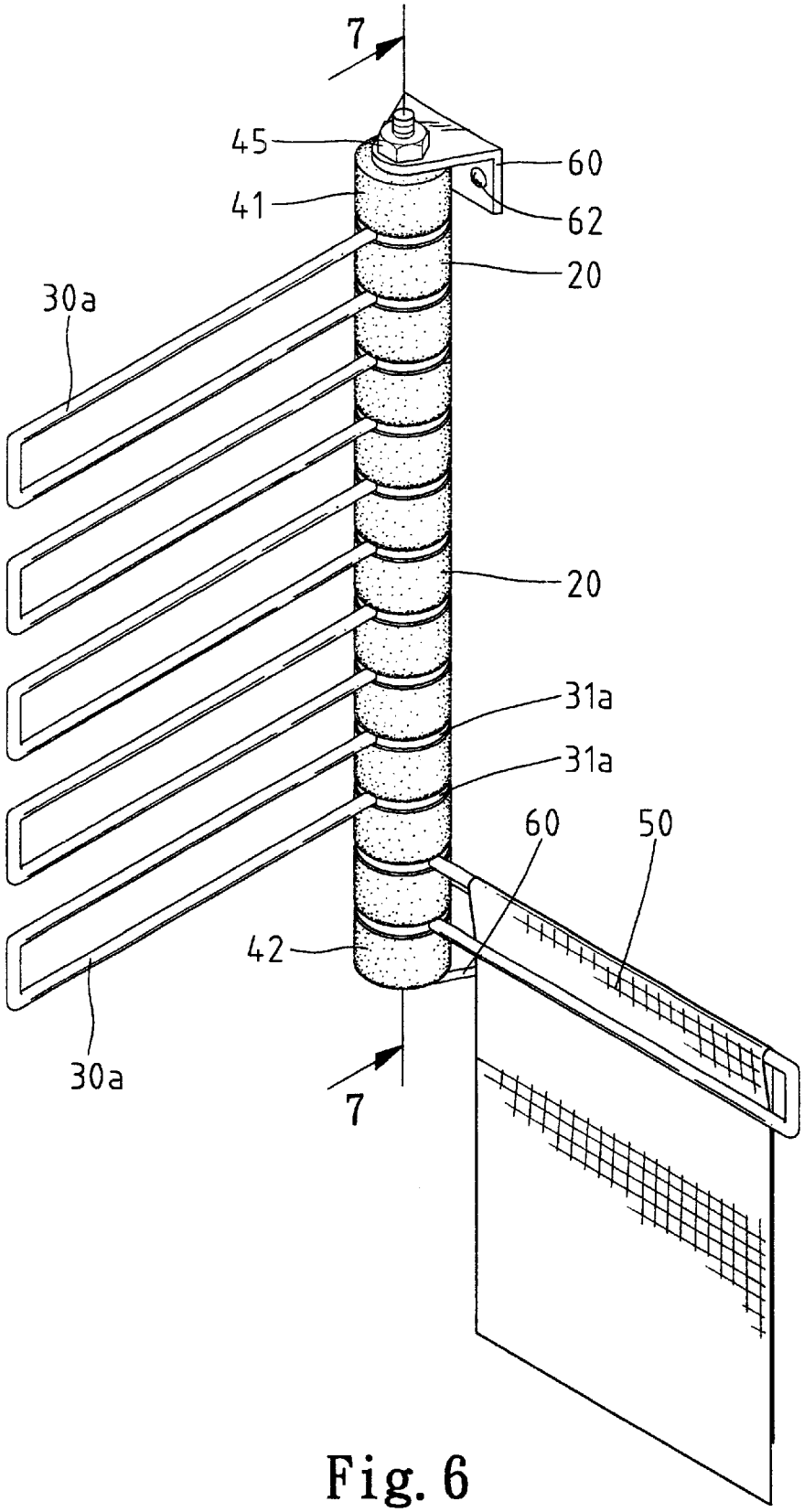
FIG. 6 is a perspective view of another modified embodiment of the rotary hanger device in accordance with the present invention.
Figure 7:
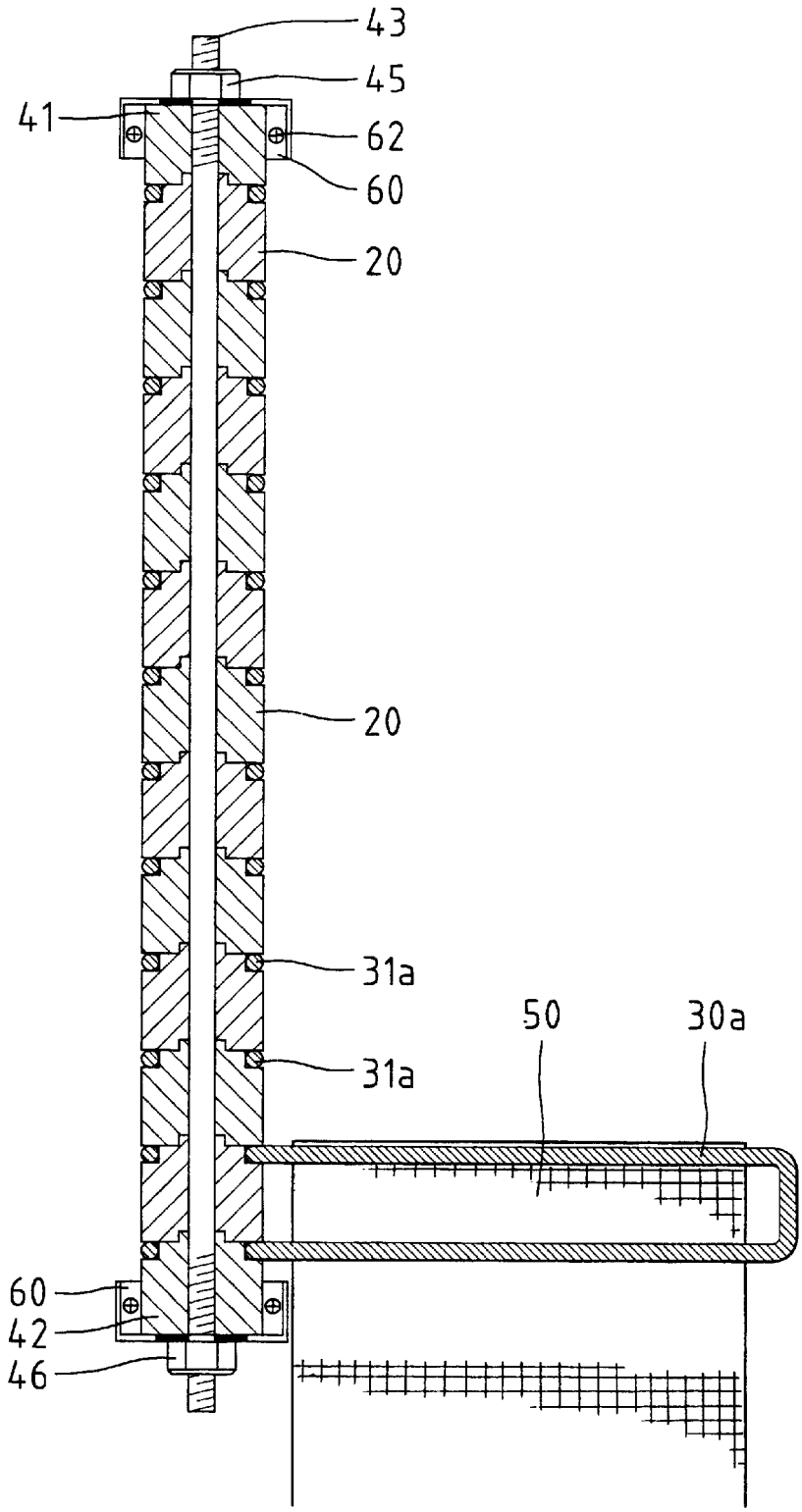
FIG. 7 is a sectional view taken along plane 7—7 in FIG. 6.

FIGS. 6 and 7 show another modified embodiment of the rotary hanger device in accordance with the present invention. In this embodiment, the rotary hanger device comprises a support rod 43, a lower positioning block 42, an upper positioning block 41, a plurality of support members 20, a plurality of rotary hanger rods 30*a*, two nuts 45 and 46, and upper and lower mounting members 60 that are secured to a wall or surface by screws 62 or the like. The support rod 43, the upper and lower positioning blocks 41 and 42, the support members 20, and the nuts 45 and 46 are identical to those of the first embodiment shown in FIGS. 1 through 4. The upper mounting member 60 is mounted to an upper end of the support rod 43 and secured on top of the upper positioning block 41 by the upper nut 45. The lower mounting member 60 is mounted to a lower end of the support rod 43 and secured to a bottom of the lower positioning block 42 by the lower nut 46. Similar to the second embodiment of FIG. 5, each rotary hanger rod 30*a* is substantially U-shaped and includes a ring 31*a* formed on a distal end of each of two limbs thereof. Each ring 31*a* of the rotary hanger rod 30*a* is mounted around the first stepped portion 23 of an associated support member 20. In particular, the rotary hanger rod 30*a* cooperates with two support members 20. Thus, a towel 50 or the like can be hung to the rotary hanger rod 30*a*.

Figure 8:
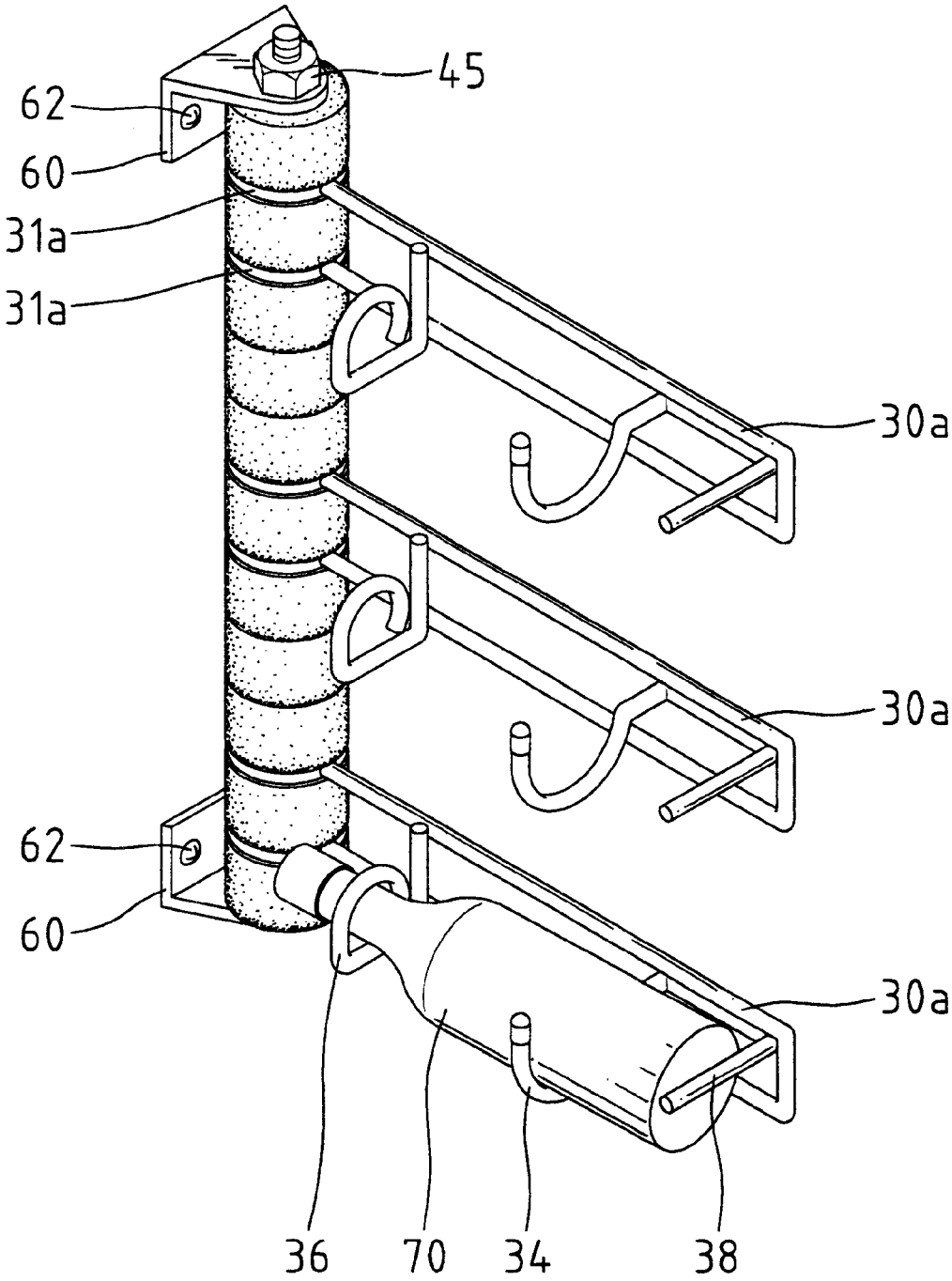
FIG. 8 is a perspective view of a further modified embodiment of the rotary hanger device in accordance with the present invention.

FIG. 8 is a perspective view of a further modified embodiment of the rotary hanger device in accordance with the present invention. In this embodiment, the rotary hanger rod 30*a* includes a neck retaining member 36 for supporting a neck of a bottle 70, a body supporting member 34 for supporting a body of the bottle 70, and a bottom retainer 38 for retaining a bottom of the bottle 70. Thus, the rotary hanger rod 30*a* can be used to support a bottle 70.

Figure 9:
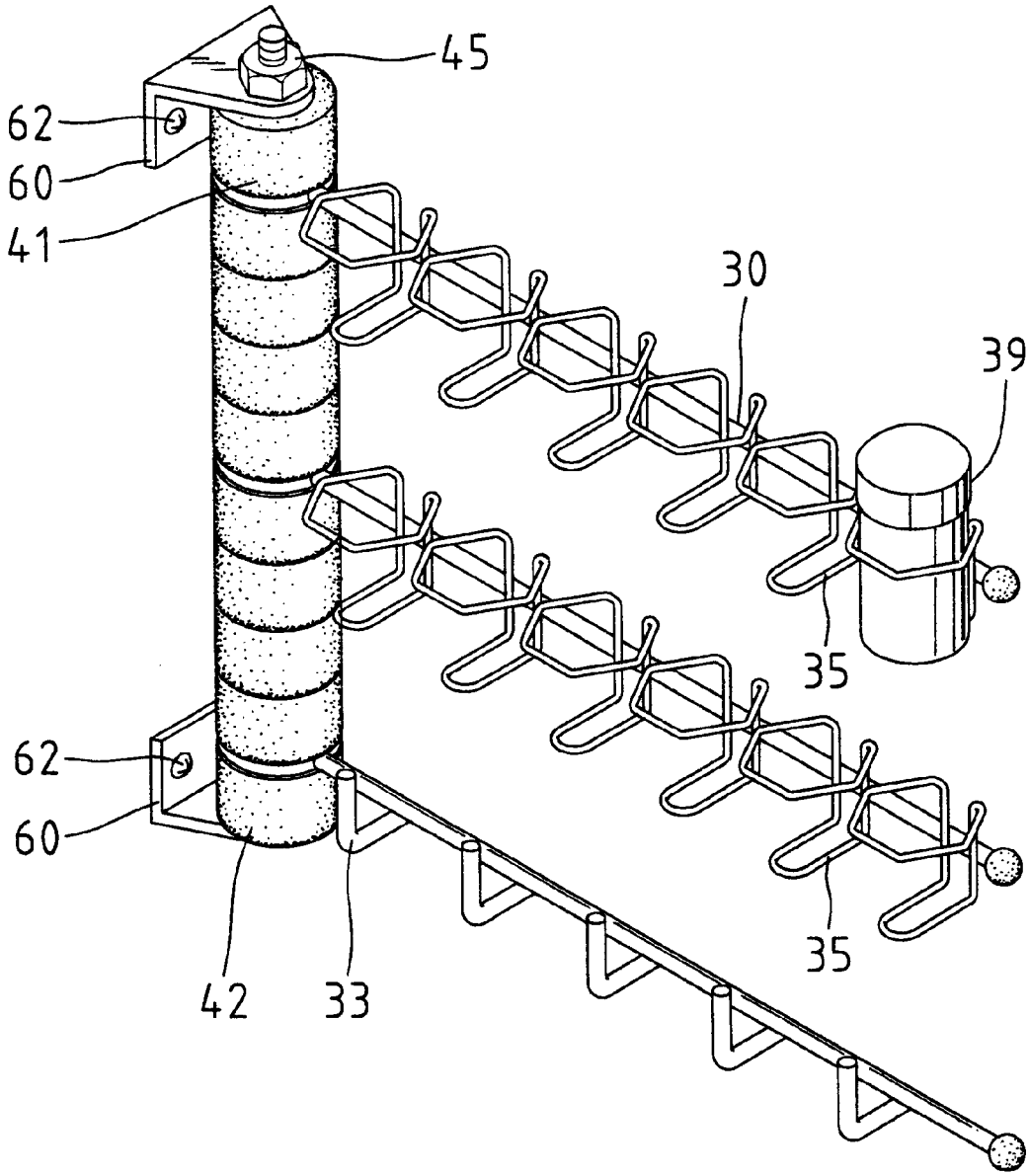
FIG. 9 is a perspective view of still another modified embodiment of the rotary hanger device in accordance with the present invention.
Figure 10:
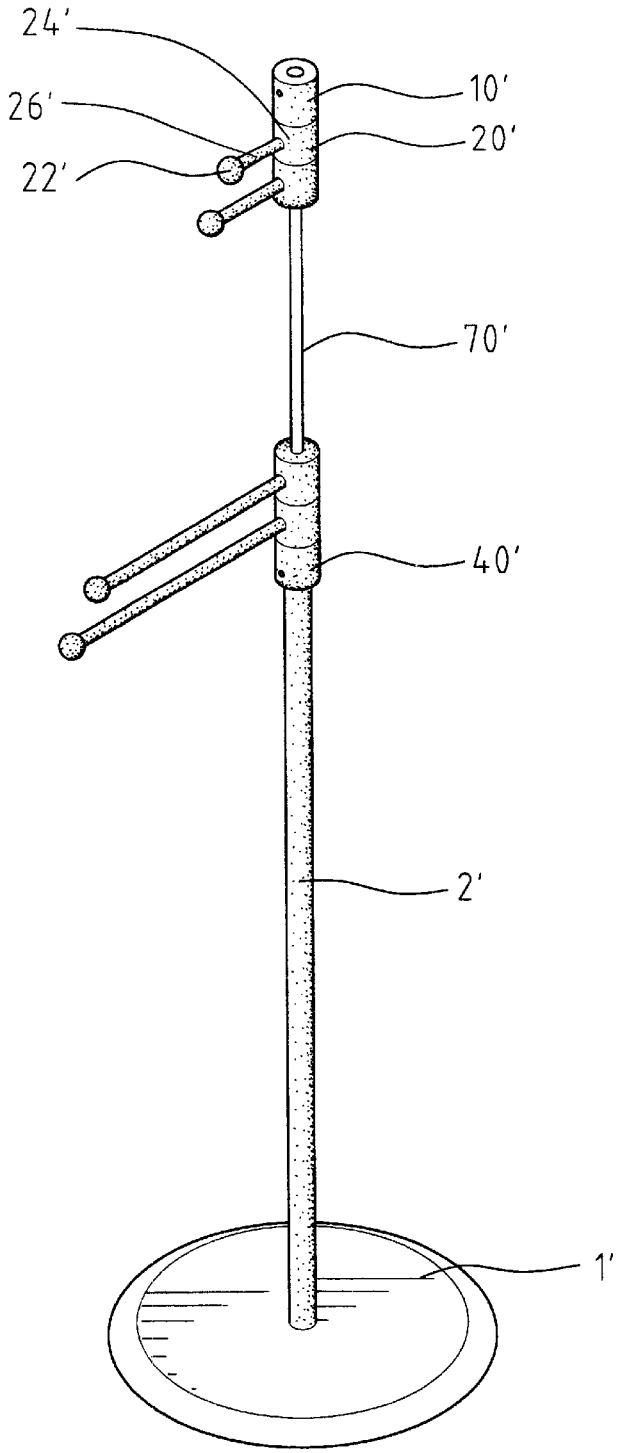
Fig. 10 PRIOR ART
FIG. 10 is a perspective view of a conventional rotary hanger device.
Figure 11:
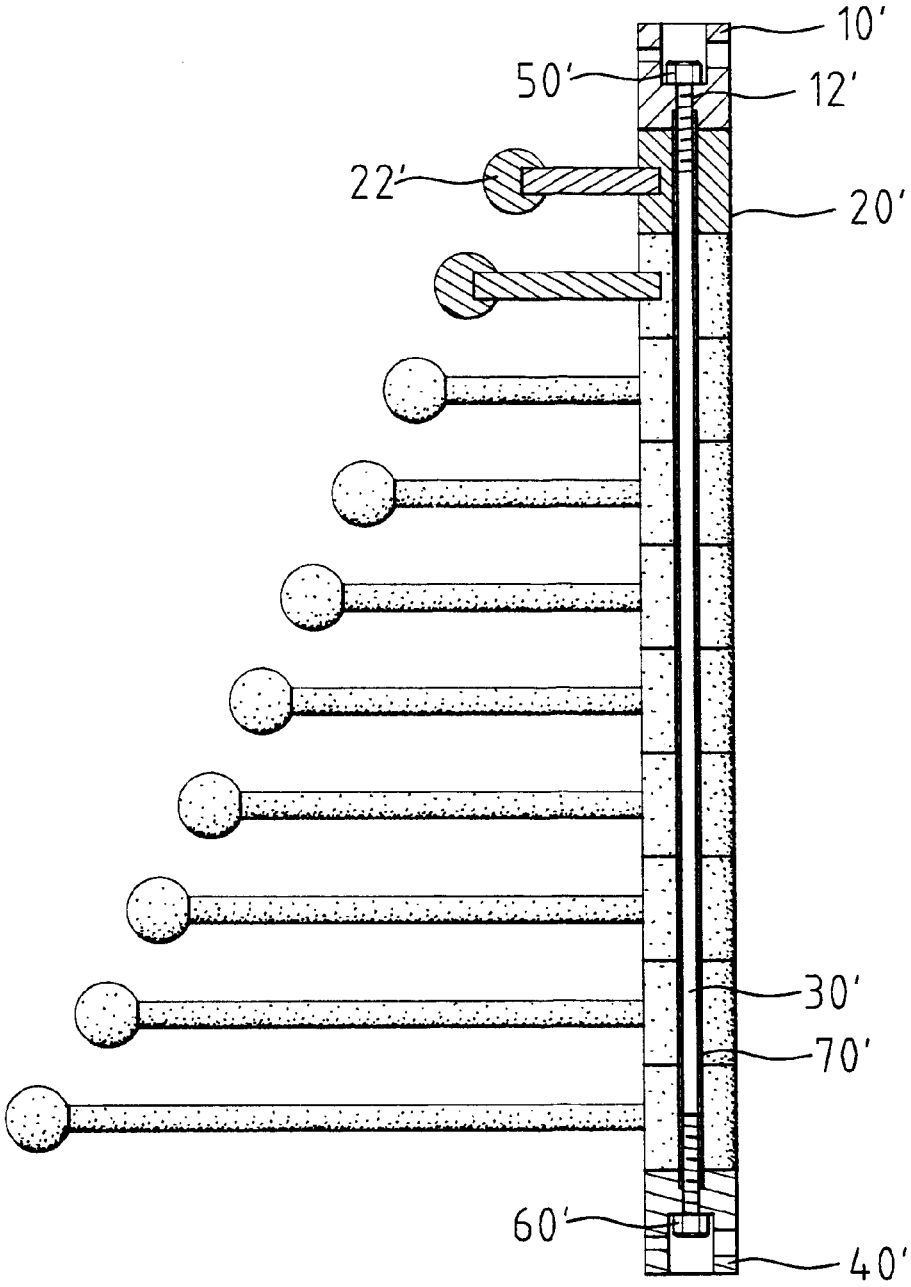
Fig. 11 PRIOR ART
FIG. 11 is a sectional view of an upper portion of the conventional rotary hanger device.

FIG. 9 is a perspective view of still another modified embodiment of the rotary hanger device in accordance with the present invention. In this embodiment, the rotary hanger device comprises a support rod 43, a lower positioning block 42, an upper positioning block 41, a plurality of support members 20, a plurality of rotary hanger rods 30, two nuts 45 (only one is shown), and upper and lower mounting members 60 that are secured to a wall or surface by screws 62 or the like. The support rod 43, the upper and lower positioning blocks 41 and 42, the support members 20, the rotary hanger rods 30, and the nuts 45 are identical to those of the first embodiment shown in FIGS. 1 through 4. The upper mounting member 60 is secured on top of the upper positioning block 41 by the upper nut 45, and the lower mounting member 60 is secured to a bottom of the lower positioning block 42 by the lower nut (not shown). In this embodiment, the rotary hanger rod 30 includes at least one holding member 35 attached thereto for holding ajar 39 or the like. Alternatively, the rotary hanger rod 30 (the lowermost one) may include at least one upwardly extending hook 33 for hanging kitchen utensil such as spoons, skimmers, ladles, etc.

It is noted that the ashtray in FIG. 5, the members 34, 36, and 38 for supporting a bottle in FIG. 8, and the hooks 33 and holding members 35 for holding jars 39 in FIG. 9 can be used with the rotary hanger device in FIGS. 1–4.

Although the invention has been explained in relation to its preferred embodiment, it is to be understood that many other possible modifications and variations can be made without departing from the scope of the invention as hereinafter claimed.

What is claimed is:

1. A hanger device comprising:

a support rod;

a plurality of support members mounted around the support rod in a stacked manner; and a plurality of the hanger rods each having a ring rotatably mounted around an associated said support member, wherein at least one of the hanger rods includes means for supporting a bottle, wherein said at least one of the hanger rods includes a neck retaining member for supporting a neck of a bottle, a body supporting member for supporting a body of the bottle, and a bottom retainer for retaining a bottom of the bottle.

2. The hanger device as claimed in claim 1, further comprising a base having a main post extending therefrom, the support rod being securely engaged with the main post.

3. The hanger device as claimed in claim 1, further comprising a nut mounted on the support rod and located above an uppermost one of the stacked support members for preventing disengagement of the support members and the hanger rods.

4. The hanger device as claimed in claim 2, wherein the support rod has a threaded lower end and the main post includes a screw hole for engaging with the threaded lower end of the support rod.

5. The hanger device as claimed in claim 1, wherein each said support member includes a stepped portion around which the ring of an associated said hanger rod is rotatably mounted.

6. The hanger device as claimed in claim 1, wherein at least one of the hanger rods includes at least one upwardly extending hook.

7. The hanger device as claimed in claim 1, wherein at least one of the hanger rods includes at least one holding member for holding a jar.

8. The hanger device as claimed in claim 1, further comprising an ashtray securely attached to one of the hanger rods.

9. The hanger device as claimed in claim 1, further comprising:

a lower positioning block mounted around the support rod, the lower positioning block including a first stepped portion formed on an upper end thereof and a second stepped portion formed on an upper end of the first stepped portion; and an upper positioning block mounted around the support rod and located above the lower to positioning block, the upper positioning block including a longitudinal through-hole having a countersink in a lower end thereof, with the plurality of support members mounted around the support rod and sandwiched between the lower positioning block and the upper positioning block in a stacked manner, each said support member including a first stepped portion formed on an upper end thereof and a second stepped portion formed on an upper end of the first stepped portion of the respective support member, with the plurality of the hanger rods each having the ring rotatably mounted around the first stepped portion of an associated said support member;

wherein the first stepped portion of the lower positioning block is fittingly received in the countersink of a lowermost one of the stacked support members, the first stepped portion of a lower one of each two adjacent said support members is fittingly received in the countersink of an upper one of each two adjacent said support members, and the first stepped portion of an uppermost one of the stacked support members is fittingly received in the countersink of the upper positioning block.

10. The hanger device as claimed in claim 9, further comprising a nut mounted on the support rod and located above an uppermost one of the stacked support members for preventing disengagement of the support members and the hanger rods.

11. The hanger device as claimed in claim 9, wherein the support rod has a threaded lower end.

12. The hanger device as claimed in claim 9, wherein one of the hanger rods is rotatably mounted around the first stepped portion of the lower positioning block.

13. The hanger device as claimed in claim 12, wherein at least one of the hanger rods includes means for supporting a bottle.

* * * * *